United States Patent [19]

Halsne

[11] Patent Number: 4,750,544

[45] Date of Patent: Jun. 14, 1988

[54] MOVABLE HEAT EXCHANGER SYSTEM

[75] Inventor: Howard Halsne, Palatine, Ill.

[73] Assignee: Swing Coil, Inc., Wheeling, Ill.

[21] Appl. No.: 901,441

[22] Filed: Aug. 28, 1986

[51] Int. Cl.[4] ..... F25B 29/00; B05D 23/00; F24F 7/00; F28D 11/00

[52] U.S. Cl. ..... 165/2; 165/16; 165/40; 165/86; 236/49

[58] Field of Search ..... 165/96, 16, 86, 103, 165/32, 40, 2; 236/49

[56] References Cited

U.S. PATENT DOCUMENTS

| | | | |
|---|---|---|---|
| 2,105,692 | 1/1938 | Hunicke | 165/96 |
| 3,695,774 | 10/1972 | Martz et al. | 165/16 |
| 3,823,768 | 7/1974 | Finger | 165/48.1 |
| 3,982,583 | 9/1976 | Shavit | 165/16 |
| 4,086,781 | 5/1978 | Brody et al. | 165/16 |
| 4,347,712 | 9/1982 | Benton et al. | 165/16 |

OTHER PUBLICATIONS

ASHRAE Handbook 1984 Systems, ASHRAE, Atlanta, Ga., copyright 1984, p. 31.16.

*Primary Examiner*—Albert W. Davis, Jr.
*Assistant Examiner*—John K. Ford
*Attorney, Agent, or Firm*—Stephen G. Rudisill

[57] ABSTRACT

A method of operating a heat exchanging system seasonally which is mounted in an air duct is disclosed. The system has means for support and movement between a first position where the heat exchanger is generally normal to the air flow in the duct, and a second position where the heat exchanger is generally parallel to the air flow in the duct. During periods of the year when the heat exchanger is not used, it is moved to the second position which is parallel to the flow of air. The static pressure caused by the presence of the apparatus in the duct is then substantially reduced when in this second position and results in reduced power consumption of a fan used to generate the air flow. The fan is automatically controlled by a volume controller with a probe which senses changes in static pressure and air flow rate in the duct. The volume controller adjusts the fan motor speed and inlet guide vanes to save more than 25% of the energy used to operate the fan over a whole year.

3 Claims, 3 Drawing Sheets

MOVABLE HEAT EXCHANGER SYSTEM

FIELD OF THE INVENTION

The present invention relates generally to heat exchanging assemblies located in air ducts.

DESCRIPTION OF RELATED ART

Conventional air conditioning assemblies typically comprise a pair of rectangular cooling apparatuses connected together to form either an A or V shaped assembly. Such assemblies are intended for permanent stationary mounting in an air duct. The cooling apparatus typically consists of a series of cooling elements, such as coils or fins, which are cooled by a liquid cooling fluid contained within or circulated through the inside of the cooling elements. Air is then forced through the system by a fan or other means; interaction of the air with the cooling elements of the apparatus results in the air temperature being lowered to the desired level. The presence of such a cooling apparatus in the air stream creates a substantial amount of static pressure and requires a considerable amount of energy to operate the fan to generate the desired air flow through the system.

It is standard practice in the air conditioning industry to combine the heating and cooling systems in the same duct work. During the periods of the year when air conditioning is required, the static pressure build-up and the associated energy required to drive the air through the cooling apparatus is an unavoidable and intrinsic feature of the system. However, during the non-cooling periods of the year when the cooling apparatus is not in operation, its presence in the air duct still demands an additional amount of energy to maintain a suitable flow of air through the air ducts for purposes other than cooling. If the static pressure caused by the cooling apparatus is reduced during the non-cooling periods, savings can be realized in the energy required to operate the fan to drive the air through the duct.

Conventional A or V shaped air conditioning assemblies are shown in U.S. Pat. Nos. 3,000,193 and 3,097,507. These assemblies are adjusted to the size of the duct at the time of installation, and then are mounted permanently in the air duct. Their presence in the air duct presents a continuous restriction to the air flow and causes a constant static pressure build up—even during non-cooling periods when the cooling apparatus is not in operation. A pivotal mounting assembly for an air conditioning apparatus which allows cleaning and servicing of the unit when the air system is not in use is disclosed in U.S. Pat. No. 3,884,048. Similarly, U.S. Pat. No. 3,411,569 shows a cooling apparatus which slides into and out of its housing so that the cooling section is readily and expeditiously removable from the combined unit for the purposes of cleaning, repairing or replacement. Such apparatuses are not suitable for large commercial or industrial cooling systems where it would require a tremendous effort to remove from the air ducts a cooling apparatus which may weigh several tons. Furthermore, such apparatuses are only removed from the air duct for maintenance purposes, and remain in the duct restricting air flow and causing static pressure at all other times.

This problem of static pressure buildup in an air duct is not unique to just cooling apparatuses; it may be caused by any apparatus in the duct which obstructs or restricts the flow of air. Additionally, savings in fan energy may be realized when any such apparatus, e.g. any heat exchanger or the like, is moved to a position of reduced static pressure when such an apparatus is not in use.

SUMMARY OF THE INVENTION

It is a primary object of the present invention to provide a heat exchanging apparatus capable of substantially reducing the amount of energy required to generate a desired air flow through an air duct containing the apparatus by substantially reducing the static pressure caused by the presence of the apparatus in the air duct during periods when the apparatus is not in use.

It is another object of the present invention to provide an easy means of movement for such a heat exchanging apparatus whereby the position of the apparatus may be moved between a dormant position (when the apparatus is not in use) and an active position whereby the static pressure caused by the presence of such an apparatus in the air duct is minimized in the dormant position.

It is another object of the present invention to provide a convenient means for operating such a heat exchanging apparatus to reduce static pressure; a means which may easily be used for large industrial and commercial air systems.

BRIEF DESCRIPTION OF THE DRAWINGS

Other objects and advantages of the invention will be apparent from the following detailed description and upon reference to the drawings, in which.

DETAILED DESCRIPTION OF THE DRAWINGS

Figure 1:
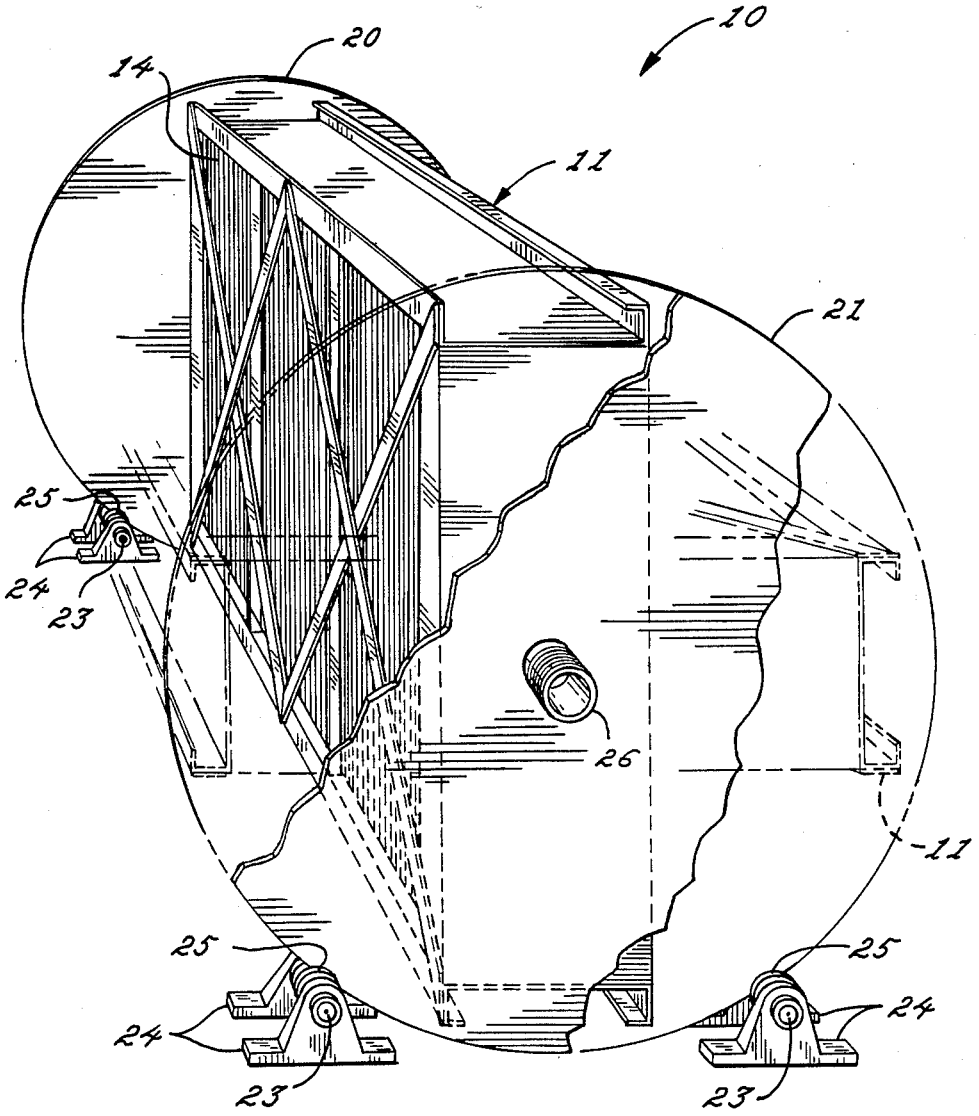
FIG. 1 is a perspective view of the movable heat exchanger apparatus.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

In particular, the following description refers to specific embodiments of the invention when used as an air conditioning apparatus. However, as emphasized in the previous statement of objectives of the invention and as will be seen from the appended claims, the invention may be applied to a much more general category of apparatuses. It can be used for any similar apparatus which may cause a restriction to the air flow in an air duct and results in static pressure buildup.

Figure 3:
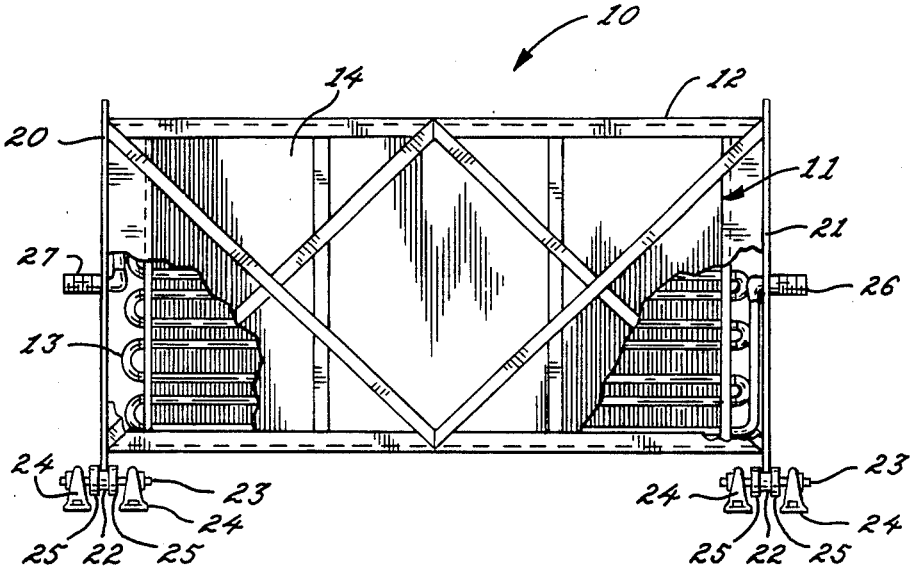
FIG. 3 is a detailed view of the heat exchanging apparatus.

Turning now to the drawings and referring first to FIG. 3, there is shown a cooling coil 10 having a conventional tubular heat exchanger 11 for carrying a fluid refrigerant along a serpentine path within a frame 12. In addition to the tubes 13 which carry the refrigerant, the heat exchanger 11 is equipped with a multiplicity of fins 14 fastened to the tubes to increase the area of the heat exchange surface. Then when warm air is passed through the heat exchanger, heat is transferred from the air to the refrigerant at a fast rate.

Figure 2:
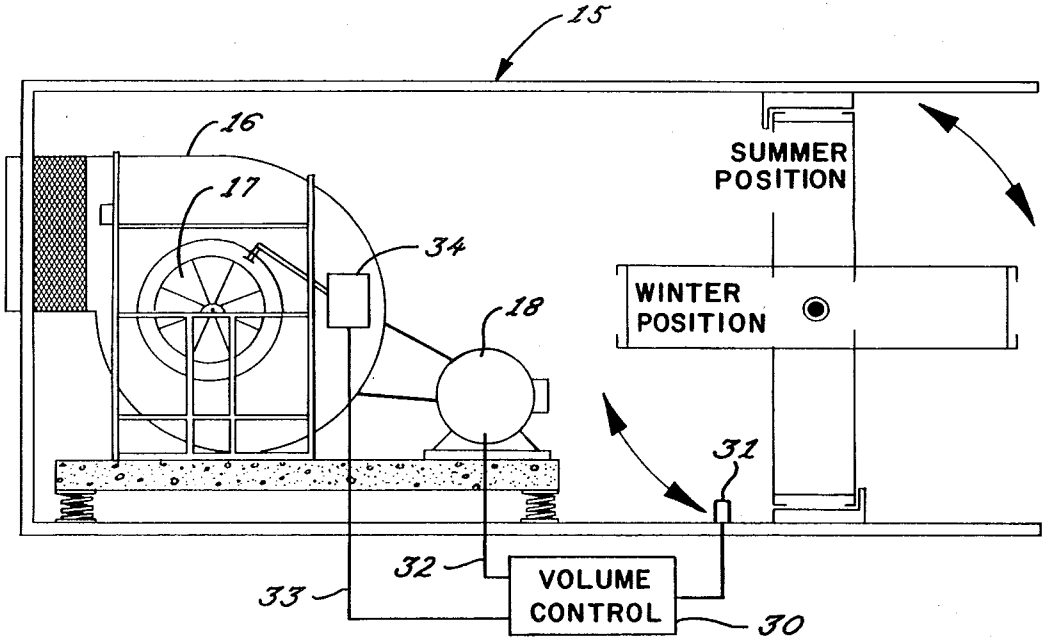
FIG. 2 is a diagram of the various elements of an air duct ventilation system including the movable heat exchanger apparatus and its two seasonal positions when depicted in its air cooling embodiment.

As shown in FIG. 2, the cooling coil 10 is mounted within an air duct 15 of a conventional heating and air conditioning system. The outside dimensions of the frame 12 are usually just slightly less than the inside dimensions of the duct so that the cooling coil fills substantially the entire cross section of the duct.

In order to force air through the duct 15 and the cooling coil 10 therein, a fan 16 is also mounted within the duct for drawing air into the system through inlet vanes 17 and propelling the air through the system. This fan 16 is driven by an electric motor 18 which has a controllable power input for regulating the rate of air flow through the duct. Because the cooling coil 10 obstructs a substantial portion of the cross sectional area of the interior of the duct, the cooling coil causes a relatively high static pressure which must be overcome by the fan in order to force air through the system at the desired rate and, thereby produce the desired cooling effect. By regulating the power input to the fan drive motor 18, the air flow rate, and the consequent cooling effect, can be controlled. Alternatively, the air flow rate may be adjusted by changing the position of the inlet vanes 17 which will result in a change in the power consumption of the drive motor 18.

In accordance with one important aspect of the present invention, the cooling coil is mounted for pivotal movement and is moved to a position where the tubular heat exchanger is generally parallel to the direction of air flow in the duct when the coil is not in use so that the air stream in the duct bypasses the heat exchanger, and the fan drive motor is operated at a reduced power input when the cooling coil is in its bypass position. This significantly decreases the energy consumption of the fan drive motor during those portions of the year when it is not necessary to cool the air, e.g., during the heating season. The energy savings realized by this arrangement can be as much as 25% of the total annual power consumed by the ventilation system.

In the illustrative embodiment, pivotal movement of the cooling coil is made possible by fastening opposite ends of the coil to a pair of support disks 20 and 21 which are supported for rotational movement on respective pairs of rollers 22. Each roller 22 is carried on a spindle 23 which has its opposite ends journaled in a pair of pillow block bearings 24 anchored to the bottom of the duct 15. The periphery of each support disk 20 and 21 rides on the outer surfaces of the corresponding rollers 22, and a pair of guide rings 25 on each roller prevent the support disk from slipping off the roller surface. Circulation of the fluid refrigerant through the tubular heat exchanger is done via refrigerant supply 26 and return 27 pipes extending through the support disks 20 and 21 on the horizontal axis of rotation. To allow rotation without loss of refrigerant, the refrigerant supply 26 and return 27 pipes may be attached to a circulation device using swivel-type fittings or similar apparatus known in the prior art.

Figure 4:
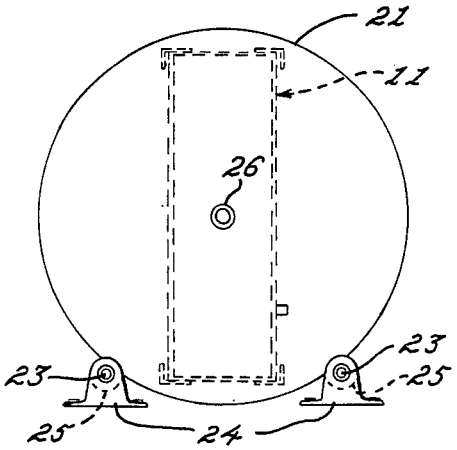
FIG. 4 is a side view of the heat exchanging apparatus as positioned when the heat exchanging effect of the apparatus is desired.

When the cooling coil 10 is being utilized, such as during the summer or "air conditioning season" in which it is necessary to cool the air passing through the duct, the coil is disposed in its vertical position as illustrated in solid lines in FIG. 2 (also illustrated in FIG. 4). When the coil is in this vertical position, the fan produces a prescribed air flow rate at a prescribed static pressure, e.g., 36,000 CFM at 4 inches of static pressure.

Figure 5:
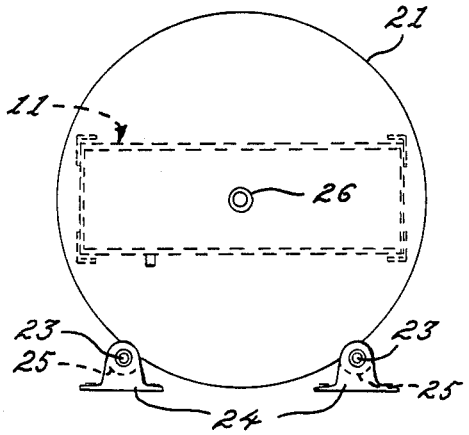
FIG. 5 is a side view of the heat exchanging apparatus in its bypass position.

When the cooling coil 10 is moved to its horizontal or "bypass" position as illustrated in FIG. 5, it significantly reduces the overall system resistance to air flow. Without any other change in the system conditions, the fan would normally produce a correspondingly increased air flow rate, due to the reduced static pressure. However, the air flow rate can be maintained constant at the prescribed level, e.g., 36,000 CFM at the reduced static pressure by adjusting the speed of the fan drive motor or the position of fan inlet vanes. These adjustments may be controlled by a volume controller which senses either the air flow rate or the static pressure in the duct and produces a corresponding electrical control signal for controlling either the speed of the fan drive motor or the position of the inlet vanes. Such volume controllers are well known as "static pressure controllers" (which measure the static pressure in the duct) or "air monitors" (which measure the air flow rate in the duct). In the particular example illustrated in FIG. 2, a volume controller 30 senses the air flow rate or static pressure in the duct 15 via a probe 31 and produces an electrical output signal on line 32 for controlling a variable speed drive motor 18.

Thus, the speed of the drive motor 18 is automatically reduced by reducing the power input to the fan drive motor. This in effect changes the static pressure versus air flow rate characteristic of the fan to produce the prescribed air flow rate (e.g., 36,000 CFM, at the reduced static pressure present in the system when the cooling coil is in its bypass position).

In another embodiment, the volume controller is used to adjust fan air volume via fan inlet guide vanes. The inlet guide vanes are opened and closed in response to air volume and static pressure requirements. Typically, the fan motor is run at a constant speed and a volume controller produces an electrical output to an inlet guide vane controller which opens or closes the vanes. As the inlet guide vanes are closed, the air is given a spin in the direction of the fan rotation resulting a lower static pressure produced by the fan and a lower horsepower requirement at the same fan speed. As illustrated in FIG. 2, a volume controller 30 senses the air flow rate or static pressure in the duct 15 via a probe 31 and produces and electrical output signal on line 33 to an inlet guide vane controller 34 which adjusts the position of the inlet guide vanes 17.

When the cooling coil is moved to its horizontal or "bypass" position the increased static pressure or air flow rate in the duct is sensed by the volume controller probe and an electrical signal is sent to the inlet guide vane controller. The inlet guide vane controller closes the inlet vanes and keeps the static pressure and air flow rate in the duct at the desired level. With the inlet guide vanes in their closed position, the power consumption of the fan motor is reduced while still producing the prescribed air flow rate (e.g., 36,000 CFM, at the reduced static pressure present in the system when the cooling coil is in its bypass position).

As can be seen from the foregoing detailed description, this invention provides an air cooling apparatus capable of substantially reducing the amount of static pressure in an air system caused by the presence of the cooling apparatus in the air duct during non-cooling periods. Specifically, the static pressure is reduced by moving the cooling apparatus to a position substantially parallel to the air flow when the cooling apparatus is not in operation (non-cooling periods). Such a reduction in static pressure has shown up to 25% savings in energy costs over a stationary cooling apparatus known in the prior art.

What is claimed is:

1. A method of operating a heat exchanging apparatus in an air duct having a variable-speed motor-driven fan, said method comprising the steps of positioning the heat exchanger in a first position where the tubular heat exchanger is disposed normal to the direction of air flow in the duct so that the air flows through the heat exchanger for temperature control during the season when the heat exchanging effect resulting from said heat exchanger is desired, and energizing the fan drive motor in a first power range to overcome the static pressure produced by the presence of said heat exchanger in said duct and force air through said heat exchanger at a prescribed air flow rate so as to produce the desired heat exchanging effect, moving the heat exchanging apparatus to a second position where the tubular heat exchanger is disposed parallel to the direction of air flow in the duct so that the air stream bypasses the heat exchanger during the season when the heat exchanging effect resulting from said heat exchanger is not desired, energizing the fan drive motor in a second power range lower than said first range when said heat exchanger is in said second position where the static pressure in the duct is reduced, thereby reducing the energy consumption by said drive motor, sensing the static pressure in said air duct and producing an electrical signal representing the static pressure in said duct, and adjusting the power input to said motor-driven fan to adjust the speed of the fan in response to a predetermined change in said electrical signal representing the static pressure.

2. The method of claim 1 wherein said heat exchanger is mounted for rotational movement around an axis extending transversely across the duct, and said heat exchanger is moved from the said first position to said second position by turning said heat exchanger about said transverse axis.

3. The method of claim 1 wherein said fan drive motor is automatically switched between said first power range and said second power range in response to a change in the static pressure in said duct.

* * * * *